United States Patent [19]

Kimberley et al.

[11] Patent Number: 4,488,857

[45] Date of Patent: Dec. 18, 1984

[54] MOUNTING ARRANGEMENT FOR INJECTION BARREL IN HOUSING OF FUEL INJECTION PUMP

[75] Inventors: John A. Kimberley, East Granby, Conn.; John B. Cavanaugh, West Springfield, Mass.

[73] Assignee: AMBAC Industries, Incorporated, Springfield, Mass.

[21] Appl. No.: 467,558

[22] Filed: Feb. 17, 1983

[51] Int. Cl.[3] ..... F04B 7/04; F04B 39/10

[52] U.S. Cl. ..... 417/490

[58] Field of Search ..... 417/289, 490, 494, 499, 417/501; 123/495, 503, 500, 373; 277/168-172

[56] References Cited

U.S. PATENT DOCUMENTS

| | | | |
|---|---|---|---|
| 2,430,801 | 11/1947 | Bremser | 417/494 |
| 2,465,046 | 3/1949 | Tabb | 417/499 |
| 3,682.572 | 8/1972 | Yarger | 417/454 |
| 3,885,895 | 5/1975 | Staudt | 417/499 |

FOREIGN PATENT DOCUMENTS

| | | | |
|---|---|---|---|
| 2705489 | 8/1978 | Fed. Rep. of Germany | 417/490 |

*Primary Examiner*—Leonard E. Smith

*Assistant Examiner*—Jane E. Obee

*Attorney, Agent, or Firm*—Stephen A. Schneeberger

[57] ABSTRACT

An improved arrangement for mounting an injection barrel in the mounting bore of a fuel injection pump housing and maintaining the integrity of a fluid seal therebetween. A pumping chamber is defined in each injection barrel. Each injection barrel includes a pair of axially spaced annular seats in the external periphery thereof, preferably beyond the axially opposite ends of the pumping chamber. A respective annular seal is seated in each of the respective seats, and when uncompressed, projects radially beyond the barrel periphery. Each mounting bore includes a pair of chamfered surfaces formed at axially spaced locations, each chamfered surface having a respective diameter sufficiently small for compressively engaging a respective seal when the barrel is mounted. The included angle of each of the chamfered surfaces is relatively small to allow axial adjustment of the mounted position of the injection barrel. The diameter of the mounting bore between the surface of the pump housing and the axially innermost chamfered surface of the pair is always greater than the uncompressed diameter of the axially innermost seal to prevent shaving.

5 Claims, 3 Drawing Figures

MOUNTING ARRANGEMENT FOR INJECTION BARREL IN HOUSING OF FUEL INJECTION PUMP

DESCRIPTION

1. Technical Field

The present invention relates to an injection pump assembly and more particularly to an improved arrangement for mounting one or more injection barrels in respective bores formed in the housing of a diesel injection pump.

2. Background Art

In diesel fuel injection pumps, and particularly in so-called in-line injection pumps in which a plurality of discrete pumping units are serially arranged in a pump housing, it is common to mount each unit pump within a respective bore formed in the pump housing. Typically, each such unit pump contained within the total pump housing includes a respective injection barrel which in turn contains a pumping plunger operating in one end thereof and an outlet valve assembly controllably closing the outlet end thereof. Such pumping unit is mounted in a respective bore in the pump housing such that the pumping plunger may be actuated by a cam and otherwise controlled by a fuel rack, both of which are also housed within the fuel pump housing and serve to control the other pumping units also.

In some such fuel injection pumps, the injection barrel of the unit pump is fitted into the respective bore formed in the pump housing in a manner such that by axially loading the barrel, a metal-to-metal seal between the barrel and housing is provided to prevent the fuel within the unit pump from leaking beyond the bore in the pump housing either to the outside environment or to the crankshaft region of the pump at which it may adversely interact with the pump lubricants and thereby increase bearing wear. Such mounting arrangement of injection barrels within respective bores in the pump housing may be objectionable however because of the considerable axial compressive forces acting on the injection barrel. These forces may be further aggravated by thermal changes in the pump and may distort the injection barrels sufficiently to interfere with the operation and/or life of the pumping plunger housed therein.

At least in part to avoid the aforementioned problem, many injection pumps mount, or more specifically suspend, the injection barrel within the pump housing bore such that the compressive forces on the barrel are substantially reduced. More specifically, the outside diameter of the injection barrel is typically somewhat smaller than that of the diameter of the bore within the pump housing into which it is to be inserted, and the lower end of the barrel is not axially loaded into sealing engagement with the housing. Then however it becomes necessary to provide additional seals for preventing the aforementioned objectionable leakage of fuel from the unit pump. Typically, a pair of resilient annular seals are positioned about a fuel injection barrel such that they provide a seal between it and the wall of the housing bore. The annular seals are axially spaced such that the portion of the injection barrel from which fuel might leak is contained therebetween. U.S. Pat. No. 3,885,895 to Staudt el al and U.S. Pat. No. 4,060,350 illustrate one such sealing arrangement in which the annular seals are housed in respective seats formed in the wall of the housing bore. That arrangement may be objectionable however because it requires each seal seat to be performed by a trepanning operation. Moreover, relatively sharp-edged shoulders formed on the outer perimeter of the injection barrel may shave or scrape the annular seals during insertion of the barrel, thereby diminishing their effectiveness as seals.

In certain other pumps, the seat for the annular seal is formed in the external surface of the injection barrel and is more easily accomplished than the aforementioned trepanning operation required for forming the seal seats within the wall of the housing bore. However, this arrangement is also less than optimum because the geometry of the housing bore has included one, and typically several, edges against which the annular seals rub during insertion or removal of the injection barrel respectively into or out of the housing bore. These edges typically include small burrs as a result of machining and are located such that deburring may be difficult or impossible. Thus, the annular seals in this arrangement may also become shaved and their effectiveness as seals impaired.

Accordingly, it is a principal object of the present invention to provide an improved arrangement for the mounting of pump injection barrels within the respective bores formed in a fuel injection pump housing. In accordance with this object it is desired to provide an improved mounting arrangement which minimizes or eliminates the wear and destruction of annular seals interposed between a respective fuel injection barrel and housing bore. Further included within this object is the provision of such improved arrangement in a cost effective manner.

In accordance with the present invention, there is provided an improved arrangement for mounting an injection barrel within the bore of a fuel injection pump housing and for maintaining the integrity of a fluid seal therebetween. In an injection pump assembly there is provided a pump housing having one and typically several, mounting bores extending thereinto from a surface thereof, and a respective injection barrel located at a mounted position in each of the mounting bores for housing a respective pumping piston in one end thereof and a respective valve in the other end. A pumping chamber is defined within each injection barrel between the respective pumping piston and valve. Each injection barrel includes at least one annular seat formed in the external periphery thereof, and a respective annular seal is contained in the seat. As used herein with reference to the seals and their seats, "annular" typically refers to an O-ring, but may also include rectangular or similar closed-loop geometries, as viewed along the axis. The annular seal, when uncompressed, normally projects radially outward beyond the external periphery of the injection barrel axially adjacent to the seals seat. The annular seal is compressed by radial engagement with the wall of the mounting bore in the pump housing when the injection barrel is in its mounted position in the bore. Each such mounting bore in the pump housing is chamfered to a diameter which is sufficiently small for the compressive engagement with the O-ring seal when the injection barrel is at its mounted position. Moreover, the diameter of the mounting bore between the surface of the pump housing and that chamfer is always greater than the diameter of the annular seal when uncompressed so as to prevent shaving the annular seal during axial displacement of the injection barrel into and out of its mounted position.

In the normal instance in which at least two axially-spaced annular seals are seated on the injection barrel, the mounting bore in the pump housing is provided with a respective pair of separate chamfered surfaces for engagement with the respective seals. To obtain the benefits of the invention, the axially outermost annular seal will be seated in a portion of the injection barrel having a first outside diameter and the second and any subsequent annular seals axially inward therefrom will be arranged about portions of the injection barrel having successively smaller outside diameters. Correspondingly, the diameter of the mounting bore in the pump housing decreases in steps between successive chamfers moving axially into the pump housing from the surface thereof.

The chamfers in each of the mounting bores in the pump housing are preferably formed at a relatively shallow angle to the bore axis to permit some axial adjustment of the final positioning of the injection barrel within the bore, yet insuring a sufficient seal between the housing and injection barrel via the O-ring seal. Preferably all of the chamfers in a mounting bore are formed at the same angle, that angle typically being less than 20°, i.e., about 14° included.

BEST MODE FOR CARRYING OUT THE INVENTION

Figure 1:
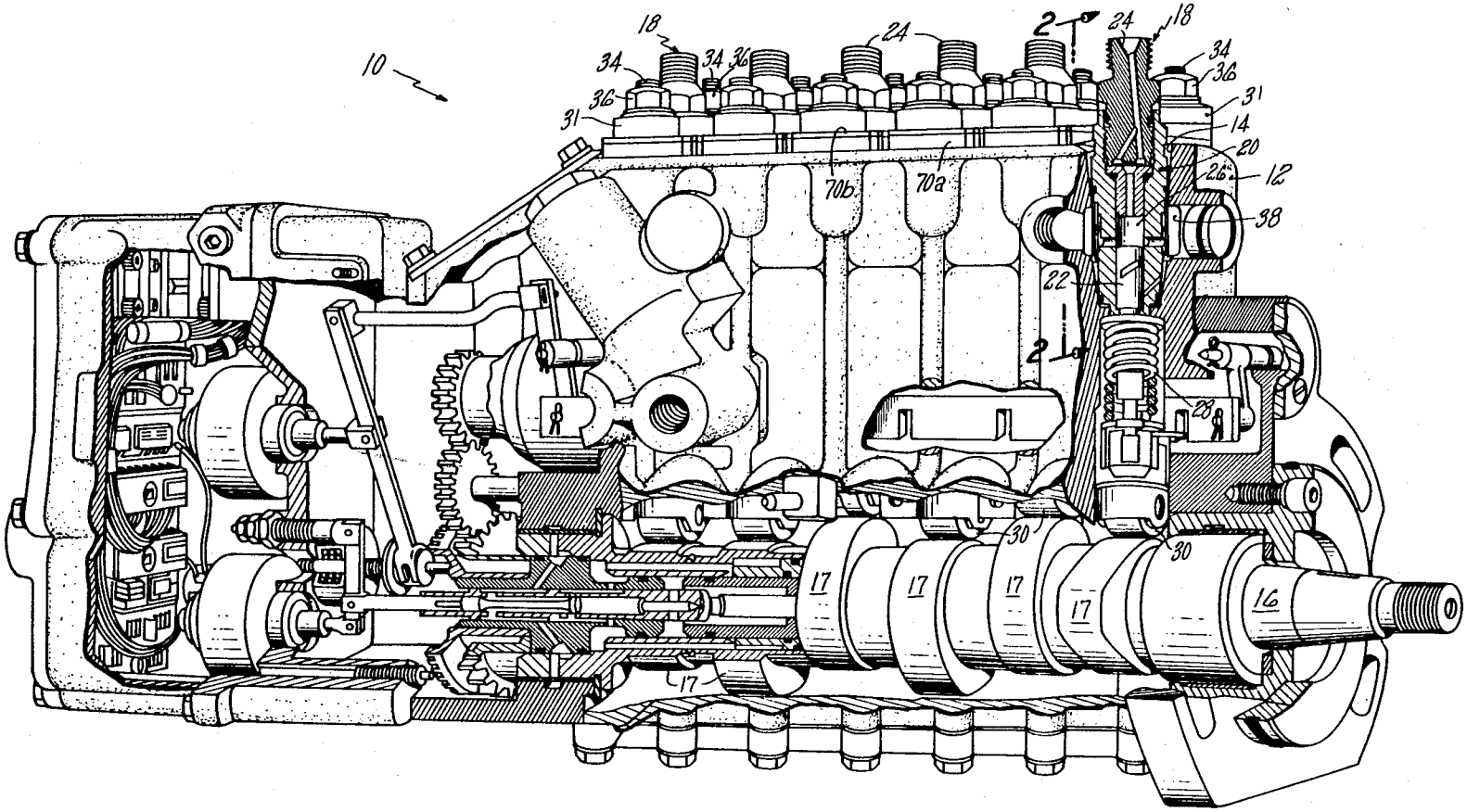
FIG. 1 is a perspective view of an in-line fuel injection pump, partly broken away to reveal a unit pump mounted within a bore formed in the housing of the fuel injection pump in accordance with the present invention.

Referring to FIG. 1, there is illustrated an in-line fuel injection pump, generally designated 10, for developing and delivering pressurized pulses of fuel to an internal combustion engine, such as a diesel. Fuel injection pump 10 includes a cast housing 12 into which are formed a series of mounting bores 14, only one of which being shown in FIG. 1. The mounting bores 14 are substantially vertically oriented, are parallel to one another and are arranged in in-line relationship. The bottom ends of the mounting bores 14 open into a front-to-rear extending cavity in which is mounted a cam shaft 16. The cam shaft 16 includes a respective cam 17 associated with each of the bores 14.

A so-called unit pump 18 is mounted in each of the housing bores 14. Each unit pump 18 includes a substantially cylindrical injection barrel 20 having a pumping piston 22 disposed for reciprocation in its lower or axially inner end and having an outlet valve assembly 24 installed in its upper or axially outer end. A pumping chamber 26 is defined within the injection barrel 20 between the pumping piston 22 and the outlet valve assembly 24. A compression spring 28 biases the pumping piston 22 downward into engagement with a cam follower 30 such that the axial displacement of the pumping piston 22 is controlled by the respective cam 17 associated therewith. The injection barrel 20 of each unit pump 18 includes a head flange portion 31 extending transversely thereof at its axially outer end. Each flange includes a pair of axial bores of slots 32 for registry with a corresponding pair of threaded openings 33 tapped into the upper surface of the pump housing 12 on either side of a mounting bore 14. Corresponding pairs of stud bolts 34 are threaded into the housing openings 33 such that their upper ends may extend upwardly through the respective bores or slots 32 in the head flange 31 of a respective injection barrel 20. Respective nuts 36 then threadedly engage the upper ends of the stud bolts 34 to maintain the injection barrel 20, and thus the unit pump 18, in a mounted position within the bore 14 of pump housing 12.

The pump housing 12 is provided with a fuel gallery 38 containing fuel at a relatively low pressure for supply to the pump chamber 26. The control ports 40 through the wall of the injection barrel 20 provide communication between the pump chamber 26 and the fuel gallery 38. The unit pump 18 operates in a well known manner by admitting fuel to the pump chamber 26 through port 40 during the down stroke of pumping piston 22. Upon the upward stroke of the pumping piston 22, the ports 40 are closed and the fuel in pump chamber 26 is pressurized to a high pressure whereupon it is ejected through outlet valve assembly 24 for deliverly via a fuel line to a fuel injector associated with the internal combustion engine. The high pressure within the pumping chamber 26 terminates when the pumping piston 22 is displaced upwardly to a position at which the upper edges of a pair of helical relief slots 48 disposed on the outer periphery of the pumping piston come into registry with the ports 40. A central bore (shown in dotted line) in the upper end of pumping piston 22 includes a radially extending lower arm which communicates with the relief slots 48 to provide the requisite relief path from the pumping chamber 26 through the piston 22 and to the ports 40. The outer periphery of the injection barrel 20 may be somewhat reduced in the region of the ports 40 to allow the positioning thereover of a baffle sleeve 42 which includes relief ports 45 for preserving communication with the fuel gallery 38. The baffle sleeve 42 may be held in position by a snap ring 44 and serves to absorb the impact energy of the fuel pulse which is emitted at the end of the fuel delivery with high energy through the control port 40.

In accordance with the present invention, the injection barrel 20 includes an upper annular seat 50 in its external surface and a lower annular seat 52 also in its external surface. Annular seals 59 and 56 of a suitable resilient material are positioned in the seats 50, 52 respectively. The annular seal 59 is positioned axially above the pumping chamber 26 and the annular seal 56 is positioned axially below that pumping chamber from preventing leakage of the fuel beyond the region of the fuel gallery 38. In the region of the upper annular seal 59, the outside diameter of the fuel injection barrel 20 is somewhat greater than it is in the region containing the lower annular seal 56. Correspondingly, the outside diameter of the annular seal 59 in its uncompressed state is somewhat greater than that of the annular seal 56 in its uncompressed state.

Referring to the mounting bore 14 in pump housing 12, it is generally formed during the casting operation, with much of the wall surface being finished by a machining operation. While the lowermost portions of the mounting bore 14 which houses the cam follower 30 may be machined by bottom entry into the housing 12, that portion of the mounting bore housing most of the injection barrel 20 extends downwardly from the uppermost surface of the pump housing 12 and is machined from that upper surface. The mounting bore 14 of the present embodiment includes a respective chamfered surface for engaging each of the annular seals 56, 59 to effect the requisite fluid seal. More specifically, an axially inner, or lower, chamfer 66 is provided for engagement with lower annular seal 56, and an axially outer, or upper chamfer 69 is provided for engagement with the upper annular seal 59. Both chamfers 66 and 69 are preferably of the same included angle $\alpha$, and that angle is relatively small. For instance, the included angle $\alpha$ chamfer 66 and 69 relative to the axis of bore 14 is less than about 20°, being about 14° in the illustrated embodiment.

Figure 2:
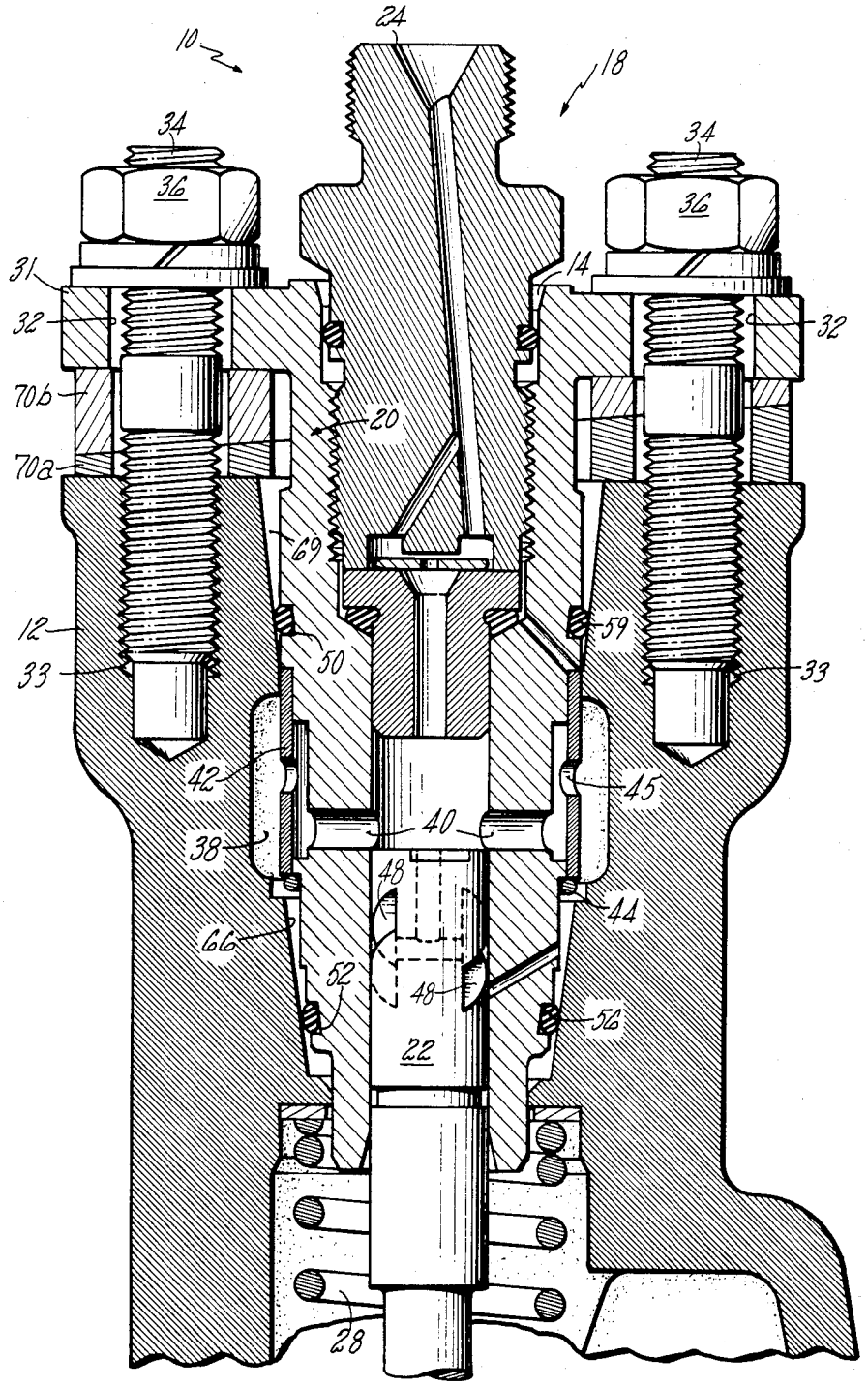
FIG. 2 is an enlarged front sectional view of a portion of the pump of FIG. 1 taken along lines 2—2 thereof, illustrating a fuel injection barrel and O-ring seals mounted in a pump housing bore in accordance with the invention.
Figure 3:
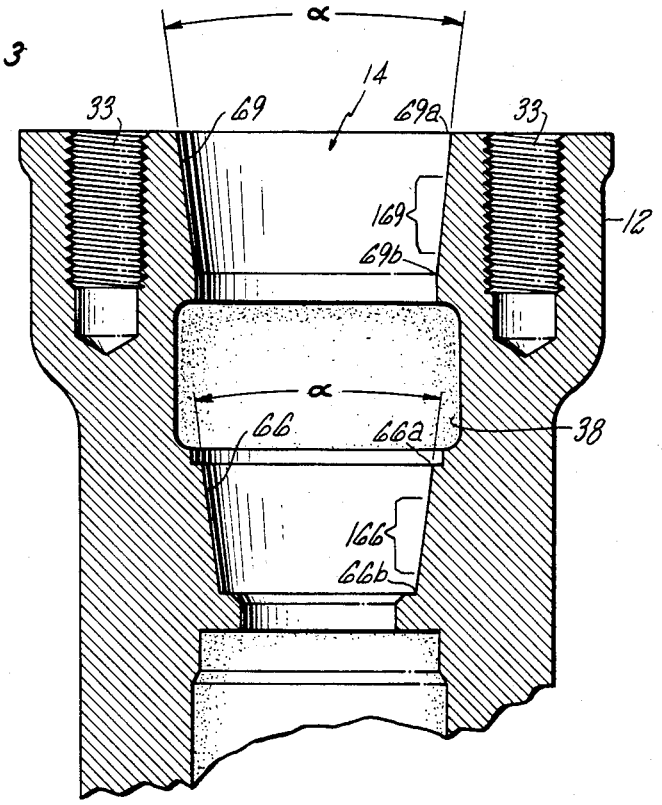
FIG. 3 is a view similar to that of FIG. 2, but having the fuel injection barrel removed to reveal the details of the mounting bore.

Referring to FIGS. 2 and 3, it is known in the type of injection pump employing a suspended injection barrel to provide for adjusting the axial positioning of the barrel, as by shims 70*a* and 70*b* between the pump housing 12 and the injection barrel head flange 31. Such axial adjustment of the mounted position of injection barrel 20 serves in a known manner to adjust the instant or timing as which the pumping piston 22 closes port 40 and thus begins the pressurized fuel pulse which is delivered to the engine. Thus by adjusting the actual or effective thickness of shims 70*a*, 70*b*, the mounted position of barrel 20 can be adjusted axially within a range, that range being represented by the bracketed zones 166 and 169 associated with the respective chamfers 66 and 69 of bore 14 which represent the respective regions of sealing engagement of the annular seals 56 and 59 with the housing 12. It will be noted that the upper and lower shoulder 69*a* and 69*b* of chamfer 69, and the upper and lower shoulder 66*a* and 66*b* of chamfer 66 are respectively beyond the axially upper and lower bounds of the zones 169 and 166 respectively such that the respective annular seals 69 and 66 are only positioned on the respective smooth chamfered surfaces in any permissible mounted position of the injection barrel.

Consistent with the aforementioned constraints, and to insure that the annular seal 56 and 59 are not shaved by contacting any shoulder or edge surface in bore 14 during insertion, axial adjustment or withdrawal of injection barrel 20, the diameter of bore 14 at lower shoulder 66*b* of chamfer 66 is less than that required for maximum radial compression of the annular seal 56 and the diameter at the upper shoulder 66*a* of that chamfer is greater than the uncompressed diameter of that annular seal. Similar geometrical constraints exist regarding the diameters of chamfer shoulders 69*b* and 69*a* relative to annular seal 59. Importantly, it should also be noted that nowhere axially above chamfer 66 in bore 14 is the diameter of that bore as small as the outside diameter of lower annular seal 56 in its uncompressed state. A similar limitation applies to the region of bore 14 above chamfer 69 relative to the uncompressed outside diameter of annular seal 59, however in the illustrated embodiment that limitation is readily met by beginning the upper edge 69*a* of that chamfer at the upper surface of the pump housing 12.

Thus there has been described an improved arrangement for mounting an injection barrel within the bore of a fueling pump and for minimizing or eliminating the deterioration of the annular seals, as by being shaved on sharp edges.

Although is invention has been shown and described with respect to detailed embodiments thereof, it will be understood by those skilled in the art that various changes in form and detail thereof may be made without departing from the spirit and scope of the claimed invention.

Having thus described a typical embodiment of the invention, that which is claimed as new and desired to be secured by Letters Patent of the United States is:

1. In an injection pump assembly for an internal combustion engine, said assembly including a pump housing having at least one mounting bore extending thereinto from a housing surface thereof, and a respective injection barrel located at a mounted position in each said mounting bore for housing a respective pumping piston in one end thereof and a respective valve means in the other end thereof, each said injection barrel including a first annular seat formed in the external periphery of a first portion thereof and a respective first annular seal being positioned in said first seat, said first annular seal normally projecting radially outward beyond the external periphery of the injection barrel axially adjacent to said first seat when uncompressed, said first annular seal being compressed by radial engagement with the wall of said mounting bore when said injection barrel is in said mounted position in said bore, the improvement wherein:

said injection barrel further includes a second annular seat formed in the external periphery of a second portion thereof and a respective second annular seal being positioned in said second seat, said second portion of said injection barrel being axially inward of said first portion and said second seat being axially spaced inwardly from said first seat, said second annular seal also normally projecting radially outward beyond the external periphery of said barrel axially adjacent to said second seat when uncompressed and also being compressed by radial engagement with the wall of said bore when in said mounted position;

said mounting bore includes first and second chamfered surfaces formed in the wall thereof at axially-spaced locations therealong, said first and said second chamfered surfaces each having respective diameters sufficiently small for said engagement with said respective first and second annular seals when said injection barrel is at said mounted position, the diameter of said bore between said second chamfered surface and said housing surface and including said first chamfered surface, being always greater than the diameter of said second annular seal when uncompressed thereby to prevent shaving said second annular seal during axial displacement of said injection barrel into or out of its said mounted position; and wherein the included angle of each of said first and said second chamfered surfaces relative to the axis of said bore is relatively small to allow axial adjustment of said mounted position of said injection barrel.

2. The pump assembly of claim 1 wherein a pumping chamber is defined within said injection barrel axially between said pumping piston and said valve means and wherein said first and said second annular seals are respectively positioned axially beyond the respective opposite ends of said pumping chamber.

3. The pump assembly of claim 1 wherein said injection barrel second portion has an outside diameter which is less than the outside diameter of said injection barrel first portion and the uncompressed outside diameter of said second seal is less than that of said first seal.

4. The pump assembly of claim 3 wherein the included angles of said first and said second chamfers are substantially the same and are less than about 20°.

5. The pump assembly of claim 4 wherein said injection barrel includes a head flange affixed thereto and further including clamping means cooperating with said head flange and said pump housing for maintaining said injection barrel in said mounted position.

* * * * *